US007758784B2

(12) United States Patent
Chelluri et al.

(10) Patent No.: US 7,758,784 B2
(45) Date of Patent: Jul. 20, 2010

(54) METHOD OF PRODUCING UNIFORM BLENDS OF NANO AND MICRON POWDERS

(75) Inventors: Bhanumathi Chelluri, Dublin, OH (US); Edward Arlen Knoth, Beavercreek, OH (US); Edward John Schumaker, Riverside, OH (US); Ryan D. Evans, N. Canton, OH (US); James L. Maloney, III, Canton, OH (US)

(73) Assignee: IAP Research, Inc., Dayton, OH (US)

( * ) Notice: Subject to any disclaimer, the term of this patent is extended or adjusted under 35 U.S.C. 154(b) by 0 days.

(21) Appl. No.: 11/531,768

(22) Filed: Sep. 14, 2006

(65) Prior Publication Data

US 2010/0124514 A1 May 20, 2010

(51) Int. Cl.
*B05D 7/00* (2006.01)
*B29C 59/00* (2006.01)

(52) U.S. Cl. ..... 264/122; 427/212; 427/215

(58) Field of Classification Search ..... 427/215, 427/212; 264/122
See application file for complete search history.

(56) References Cited

U.S. PATENT DOCUMENTS 3,066,391 A 12/1962 Vordahl
3,208,848 A * 9/1965 Levey, Jr. ..... 419/19
3,416,918 A * 12/1968 Roberts ..... 419/19
3,660,049 A 5/1972 Benjamin
4,678,761 A * 7/1987 Virkar et al. ..... 501/104
4,749,545 A 6/1988 Begg et al.
5,069,713 A * 12/1991 Harris et al. ..... 75/232
5,358,734 A * 10/1994 Lenox et al. ..... 427/71
5,589,652 A 12/1996 Arato et al.
5,624,602 A * 4/1997 Lenox et al. ..... 252/301.4 F
5,854,966 A 12/1998 Kampe et al.

(Continued)

FOREIGN PATENT DOCUMENTS

EP 10 07 750 B1 2/1999

(Continued)

OTHER PUBLICATIONS

Dudina, D., Dae-Hwan Kwon, Khoa Xuan Huynh, Thuy Dang Nguyen, Ji-Soon Kim, Young-Soon Kwon. (2005),"Nanoscale TiB/sub 2/-dispersed Cu-matrix composite produced by a high-energy milling and self-propagating high-temperature synthesis process", Proceedings. The 9th Russian-Korean International Symposium on Science and Technology, (IEEE Cat. No. 05EX1018); 430-433.

(Continued)

*Primary Examiner*—Michael Cleveland
*Assistant Examiner*—Robert Vetere
(74) *Attorney, Agent, or Firm*—Jacox, Meckstroth & Jenkins

(57) ABSTRACT

A method of uniformly dispersing a nano powder throughout a micron powder. Ordinary mixing or agitation does not succeed in attaining uniform dispersal: the nano powder agglomerates into microscopic masses. In one form of the invention, a charge of a micron powder, with fifty weight percent of charge of nanopowder is loaded into a ball mill. The mixture is ball milled for less than two hours, at room temperature in a dry condition, and produces a highly uniform distribution of the nano powder throughout the micron powder.

23 Claims, 5 Drawing Sheets

U.S. PATENT DOCUMENTS

| | | | | |
|---|---|---|---|---|
| 5,993,731 | A | 11/1999 | Jech et al. | |
| 6,264,719 | B1 | 7/2001 | Zhang et al. | |
| 6,656,246 | B2 | 12/2003 | Kanoya et al. | |
| 6,695,985 | B2 * | 2/2004 | Igarashi et al. | 252/518.1 |
| 7,060,120 | B1 | 6/2006 | Kanoya et al. | |
| 2002/0033209 | A1 | 3/2002 | Kanoya et al. | |
| 2005/0268746 | A1 | 12/2005 | Abkowitz et al. | |
| 2007/0057415 | A1 | 3/2007 | Katagiri et al. | |

FOREIGN PATENT DOCUMENTS

| | | | |
|---|---|---|---|
| EP | 1174385 | A2 | 1/2002 |
| FR | 2782096 | A1 | 2/2000 |
| GB | 1046330 | A | 10/1966 |
| GB | 1280833 | * | 7/1972 |
| GB | 1280833 | A | 7/1972 |
| JP | 2002053902 | A | 2/2002 |
| WO | 99/09227 | | 2/1999 |
| WO | 99/09277 | A1 | 6/2000 |
| WO | 2005040068 | A1 | 5/2005 |
| WO | 2007004635 | A2 | 4/2007 |

OTHER PUBLICATIONS

Emura, S.; Hagiwara, M. (2001) Mechanical properties of TiB particulate reinforced Ti2AINb intermetallics produced by prealloyed powder metallurgy method. International Journal of Materials and Product Technology,16, (1-3): 103-108.

Fogagnolo J. B., Robert M. H., Torralba J. M.;"The effects of mechanical alloying on the extrusion process of AA 6061 alloy reinforced with Si3N4". J. Braz. Soc. Mech. Sci. & Eng., 25 (2), Apr./Jun. 2003.

Guo-Dong Zhan; Kuntz, J., Wan, J., Garay, J., Mukherjee, A. K. (2002), "Syntheses of Nd/sub 2/Ti/sub 2/O/sub 7//AI/sub 2/O/sub 3/ nanocomposites by spark-plasma-sintering and high-energy ball-milling"; Ultrafine Grained Materials II. Proceedings. TMS Annual Meeting, pp. 219-224.

Jeong, H. W.; Kim, S. J.; Hyun, Y. T.; Lee, Y. T. (Feb. 2002) Densification and compressive strength of in-situ processed Ti/TiB composites by powder metallurgy. Metals and Materials, 8, (1): 25-35.

Kamiya, Akira; Watazu, Akira; Zhu, Jun; Naganuma, Katsuyoshi (2000) Fabrication of alumina chopped fiber reinforced titanium matrix composites. Journal of Materials Science Letters, 19 (6): 461-464.

Kawabata, K.; Sato, E.; Kuribayashi, K. (2001) Creep behavior of in-situ TiB fiber reinforced Ti matrix composite. Proceedings of the 9th International Conference on Creep & Fracture of Engineering Materials & Structures: 331-339.

Kunrath, A. O.; Strohaecker, T. R.; Moore, J. J. (Jan. 15, 1996) Combustion synthesis of metal-matrix composites. I. The Ti-TiC-AI2O3 system. Scripta Materialia, 34, (2): 175-181.

Ismail, R., Yaacob, I. I.; "Synthesis and characterization of nanocrystalline Ni/sub 3/AI intermetallic via mechanical alloying and reaction synthesis". Key Engineering Materials (Switzerland), vol. 306-308: 1121-1126, (2006).

Lu, W.; Zhang, D.; Zhang, X.; Wu, R.; Sakata, T.; Mori, H (Nov. 2000) Microstructure and compressive properties of in situ synthesized (TiB+TiC)/Ti composites. Materials Transactions, JIM, 41, (11):1555-1561.

(Oct.-Dec. 1999) APIC—revolutionary new process for metal-matrix composites. Composites & Adhesives Newsletter, 16, (1): 4.

Peng, L. M.; Zhu, S. J. (2003) Creep of metal matrix composites reinforced by combining nano-sized dispersoids with micro-sized ceramic particulates or whiskers (review). International Journal of Materials and Product Technology, 18, (1-3): 215-254.

Prabhu, B., Suryanarayana, C., An L., Vaidyanathan R. (2006); "Synthesis and characterization of high volume fraction AI—AI203 nanocomposite powders by high-energy milling"; Materials Science and Engineering A, 425: 192-200.

Singh, P., Umesh, P. (1998) "Sintered nickel steel matrix composites produced by mechanical alloying"; Advances in Powder Metallurgy & Particulate Materials, vol. 2, Parts 5-9: 6.49-6.61.

Smith, R.W. (Feb. 1, 1993) Reactive plasma spray forming for advanced materials synthesis. Powder Metallurgy International, 25 (1): 9-16.

Tomasi, R., Rabelo, A. A., Chinelatto, A. S. A, Reis, L., Botta, W. J. ; "Characterization of high-energy milled alumina powders. Ceramica, (Sep.-Oct. 1998) ; pp. 166-170".

Wang, Z.; Li, M. L.; Shen, Q.; Zhang, L. M. (2003) Fabrication of Ti/AI2O3 composites by spark plasma sintering. Key Engineering Materials, 249: 137-140.

Woodman, R H, Klotz, B R, Dowding, R J. (2005) ; "Evaluation of a dry ball-milling technique as a method for mixing boron carbide and carbon nanotube powders". Ceramics International, 31 (5): 765-768.

Wu, R. J.; Lu, W. J.; Zhang, D.; Zhang, X. N.; Sakata, T.; Mori, H (Oct. 2000) HREM study of TiB/Ti interfaces in a Ti-TiB-TiC in-situ composite. International Conference on Composite Interfaces, 8: 11.

Zhang, D.L., Cai, Z. H. (2003); "Sintering and Mechanical Properties of Titanium Based Metal-Ceramic Composites Produced from Reduction of Titanium Dioxide"; Materials Science Forum. vols. 437-438: 297-300.

Zhang, D.L.; (2004) Processing of Advanced Materials Using High-Energy Mechanical Milling. Progress in Materials Science (UK), vol. 49; No. 3-4: pp. 537-60.

Zhang, X. N.; Wu, R. J. (2003) Manufacture and performance of particulate reinforced titanium matrix composites. Key Engineering Materials, 249: 205-210.

Tsipas, S. et al.: "Effect of High Energy Ball Milling on Titanium-Hydroxyapatite Powders" Powder Metallurgy, Maney Publishing, London, GB, vol. 46, No. 1, Mar. 2003, pp. 73-77, XP001162474.

Eylon, Daniel, Froes, F.H. (Sam), Abkowitz, Stanley, "Titanium Powder Metallurgy Alloys and Composities," Volume 7: Powder Metal Technologies and Applications, ASM Handbooks Online, 2002.

Suryanarayana, C., "Mechanical Alloying"; vol. 7, 2002, ASM Handbook, ASM International.

Glossary of Metallurgical and Metalworking Terms, Metals Handbook, ASM Handbooks Online, ASM International, 2002.

Particle Size-Mesh Conversions, Sigma Aldrich.

* cited by examiner

METHOD OF PRODUCING UNIFORM BLENDS OF NANO AND MICRON POWDERS

STATEMENT OF GOVERNMENT INTEREST

This invention was made with United States Government support under SBIR Grant No. DE-FG02-03ER-83679. The United States Government has certain rights in this invention.

RELATED APPLICATION

This patent application is related to that entitled "MICRON SIZE POWDERS HAVING NANO SIZE REINFORCEMENT," Ser. No. 11/531,771, filed Sep. 14, 2006, and which is hereby incorporated by reference.

BACKGROUND OF THE INVENTION

1. Field of the Invention

This invention relates to nano powders/particulates and micron powders/particulates and mixtures thereof.

2. Description of the Related Art

Nano powders/particulates (<100 nm size) produced by various synthesis methods such as gas condensation, sol gel, flame synthesis and other methods typically are in the agglomerate form. These agglomerates are very difficult to handle for using them in powder metallurgy processing operations such as filling into dies and compacting into uniform net shape.

Attempts to break up such nano powder agglomerates using conventional blending processes, ultrasonic mixing or simple milling proved not highly successful.

In the technology of powder metallurgy, different types of powders are blended together, sometimes with the inclusion of lubricants. Different types of blending devices are used, one type being the well-known V-blender.

A problem has been observed in attempting to mix together specific sizes of powders, such as nano-sized powders with micron-sized powders. When one mixes two such powders in the conventional manner and then attempts to compact and sinter the mixture, it is found that the nano powders tend to clump together and form separated islands within the matrix of the micron-powders. A highly homogeneous mixture is not attained.

FIG. 1 is a photo-micrograph of such a mixture. The bright areas indicate the metallic phase. The dark areas indicate the ceramic material. The reference dimension is 200 micrometers or 200 microns.

The lack of homogeneity causes the physical and chemical properties to be non-uniform throughout the bulk of the mixture of powders. This non-uniformity carries over to the sintered product, which will also exhibit variance in properties throughout. The variance is not desired in many situations.

Sometimes milling is used to produce fine powders, by pulverizing coarser particles into a finer size. Milling can also be used to achieve mechanical alloying of two different powders.

In the ball milling process generally, one or more powders are placed into a milling jar, together with balls (or suitable grinding media) of hard material. The milling jar is rotated, to cause the contents to tumble. During the tumbling, the hard balls fracture the powders into finer sizes. If the milling is done at appropriate speeds for long duration, such as more than 10 hours, freshly formed surfaces of different materials react and mechanical alloying takes place.

What is needed is a system and process that overcomes one or more of the problems of the prior art.

SUMMARY OF THE INVENTION

The Inventors have developed a process that deagglomerates nano or fine powders to enable their homogenous distribution in other powder materials for powder metallurgy processes and net shape forming using short ball milling times at low speeds, which reduces, or eliminates, the non homogeneity in distribution of the nano powder.

An object of the invention is to provide an improved process for blending nano powders with micron-powders.

A further object of the invention is to provide a process for blending fine size (e.g., less than 10 microns) and nano (100 nanometers or less) powders or particulates with micron powders or particulates, which produces a highly uniform distribution of both powders throughout the mixture.

In one form of the invention, a hard nano powder of 0 to 50 weight % is combined with a soft micron powder. The mixture is situated in a mill, such as a ball mill or jet mill, and milled for a short time, such as four hours or less. The ball milling rotational speed is less than 109 rpm in a 5.5 inch diameter jar. This process produces a mixture in which the nano powder is uniformly dispersed.

In one aspect, one embodiment comprises a method, comprising: placing first particles into a low energy ball mill (milling to deagglomerate), the first particles ranging in size from S1 to S2, and all first particles being smaller than 100 nano meters; placing second particles into the ball mill, the second particles ranging in size from (10×S1) to (2000×S2); and operating the ball mill at room temperature for mixing the two powders. Desirably, the ball mill provides minimal amount of shearing action, while permitting the softer matrix powder to be coated with the fine-size or nano powders.

In another aspect, one embodiment comprises a method, comprising: mixing first particles ranging in size from S1 to S2, and all first particles being smaller than 100 nano meters; placing second particles with second particles ranging in size from (10×S1) to (2000×S2) to permit the softer matrix powder to be coated with the fine-size or nano powders.

In another aspect, one embodiment comprises a method, comprising: combining a nano-sized powder of one material with a micron-sized powder of another material; and ball-milling the particles to produce a mixture in which the number of nano-sized particles in any volume is substantially proportional to the surface area of micron-sized particles in the volume.

In still another aspect, one embodiment comprises a method, comprising: preparing a mixture which includes a relatively hard powder of average particle size X, and a relatively soft powder, of average particle size greater than 10X; and subjecting the mixture to ball milling in a dry condition for no more than four hours. The short milling times enable dispersion of finer powders in micron-size powders without mechanical alloying.

These and other objects and advantages of the invention will be apparent from the following description, the accompanying drawings and the appended claims.

Figure 2:
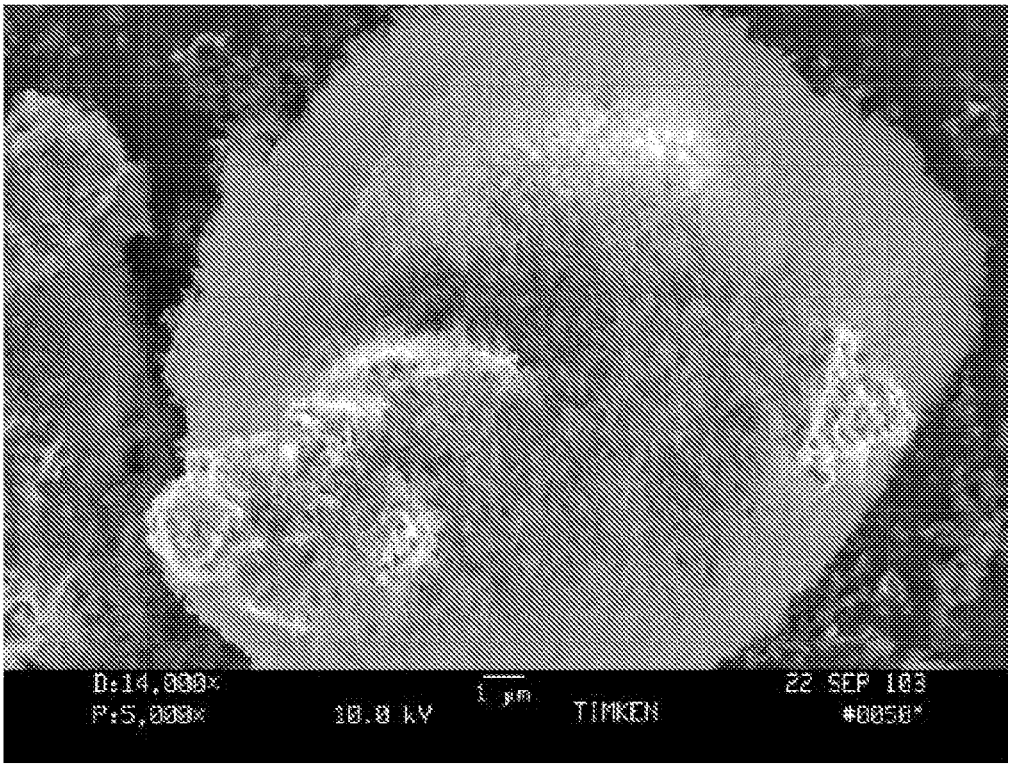
FIG. 2 shows scanning electron micrograph of a hybrid powder particle (prepared via gentle ball milling process)
Figure 3:
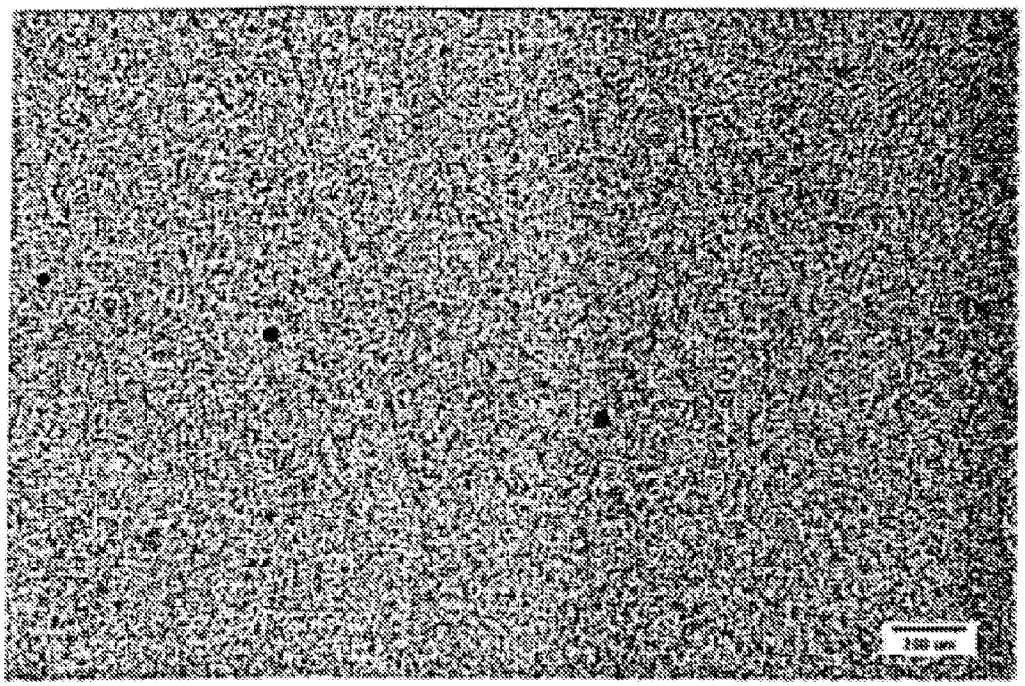
Figure 4:
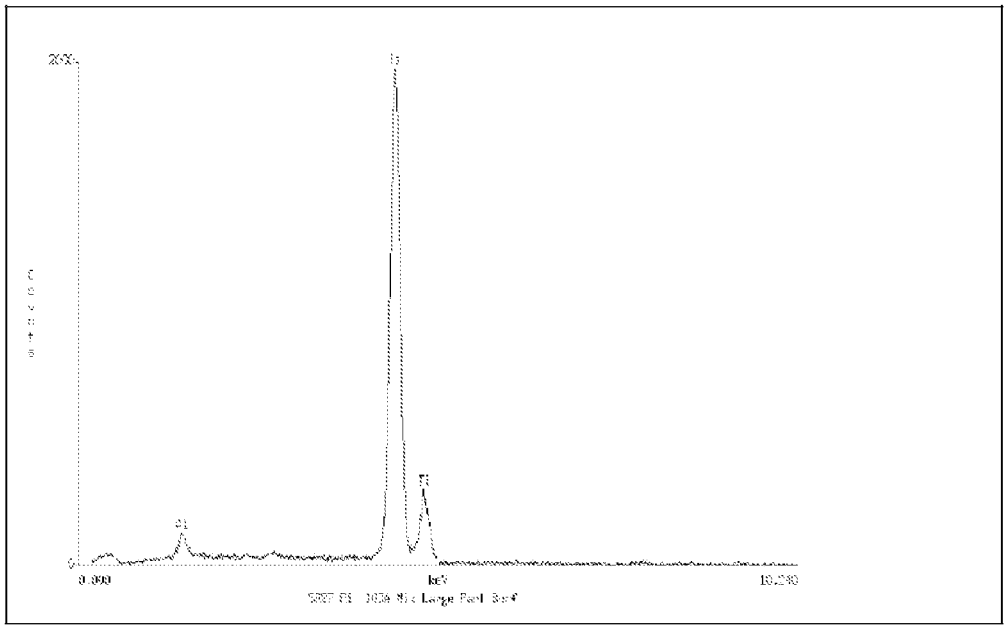
Figure 5:
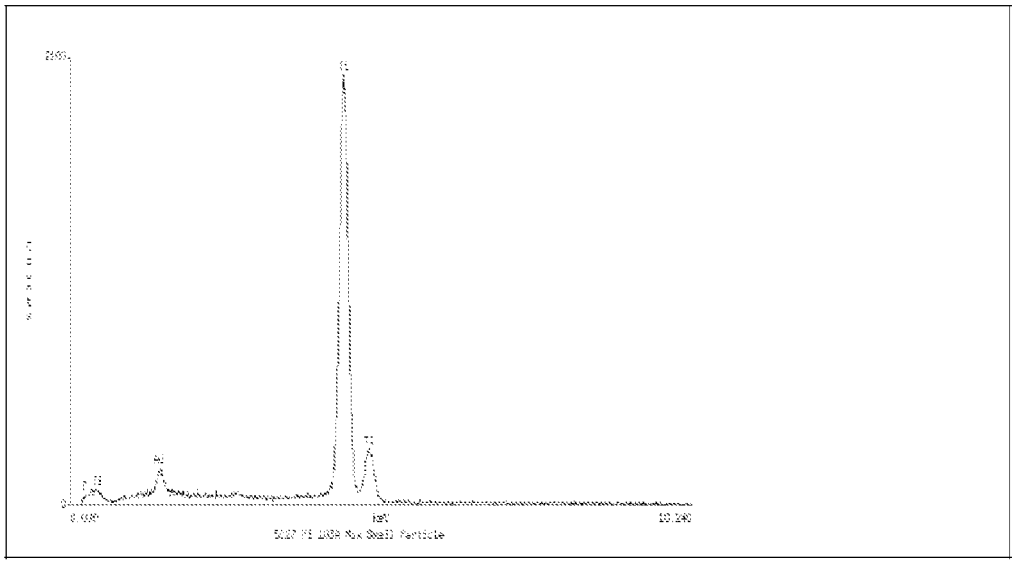
Figure 6:
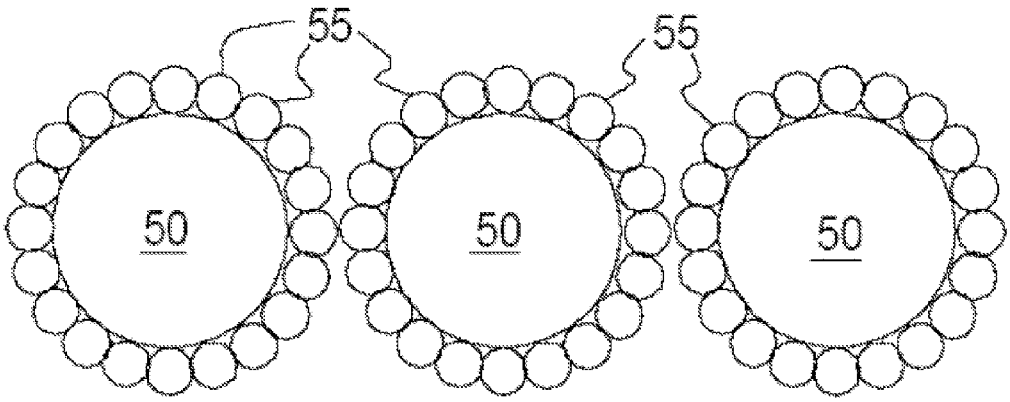

described in the Background of the Invention consisting of a metallic micron powder particle coated with nano ceramic powder particles;

FIG. 3 shows the photomicrograph of such powder blends after sintering and the uniformity of microstructure of sintered material is noteworthy and is a desirable feature in many applications;

FIGS. 4 and 5 are test plots of energy dispersive x-ray undertaken on the particles discussed herein in FIG. 2; and FIG. 6 illustrates, in simplified form, circles, which represent acyclic particles, for purposes of measuring particle concentration.

DETAILED DESCRIPTION OF THE INVENTION

The invention combines a charge of nano-sized powder with a charge of micron-sized powder in a ball mill. Preferably, the diameter of the micron-sized powder is about 10-2000 times that of the nano-sized powder. In one example, a 20 to 30 nano meter titanium carbide powder is combined with a 20 micron titanium metal powder. The titanium metal powder is relatively soft compared to the carbide. This combination was ball-milled using ¼-inch and 3/16 inch alumina balls, at 109 rpm speed, in a dry condition for two hours. The ball mill used was a model no. 784AVM, manufactured by U.S. Stoneware located in East Palestine, Ohio.

The hybrid powder produced by the ball milling process was found to possess good flow characteristics, which is desirable for powder filling and compaction, as used in sintering operations.

Figure 1:
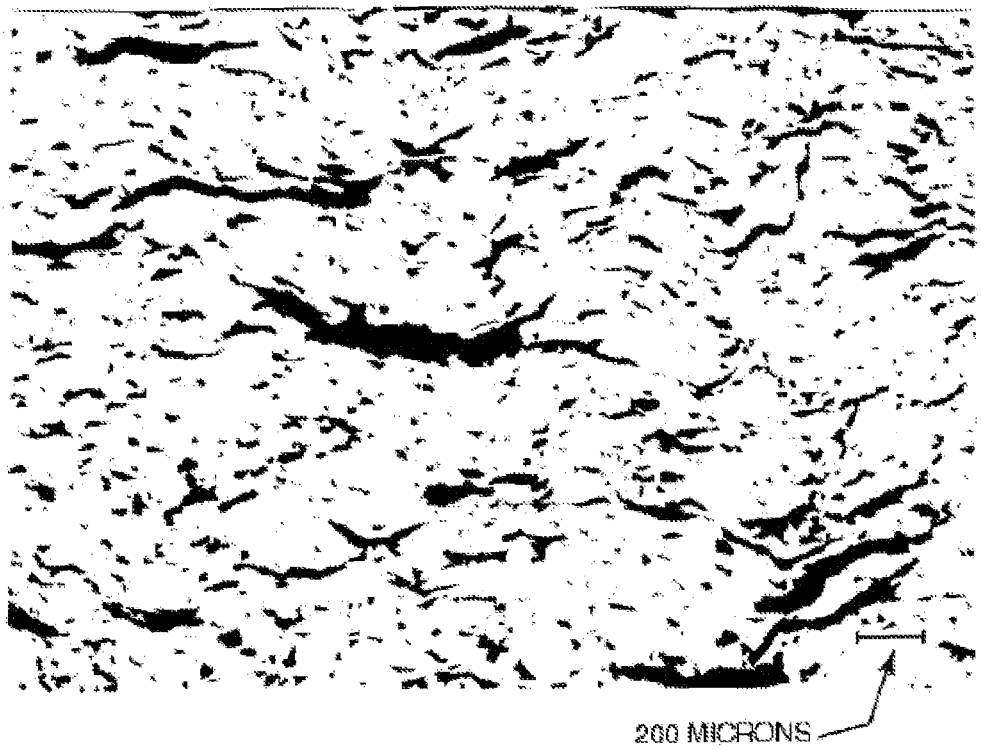
FIG. 1 is a photo-micrograph of a metallic micron powder mixed with a ceramic nano powder, mixed using conventional agitation.

In addition, after compacting and sintering, the individual components, that is, the titanium metal and the titanium carbide, were found to be much more uniformly distributed throughout the bulk of the material, compared with compaction and sintering done using an ordinary mixer, such as a V-blender, which produces a result of the type shown in FIG. 1.

One definition of the term uniform is any distribution of particles that minimizes or eliminates agglomerations in the sintered part, for example, for any cell, N is always within five percent of the average. Thus, in this example, if N is always more than 950 and less than 1050, then the smaller particles are considered to be uniformly distributed.

Another definition is that N is within five percent of the average for more than 90 percent of the cells.

Similar definitions can be applied to uniformity in distribution of the larger particles.

The ball milling accomplishes at least two objectives. One, it de-agglomerates the nano powder. Two, it coats the nano powder onto the micron particles. In particular, it is believed that the ball milling embeds the nano particles into the larger, softer, micron particles, thereby mechanically locking the smaller particles into the larger particles to some extent.

For a given amount of micron-sized powder, a certain amount of nano powder is required to provide a single layer of coating. If a larger amount of nano powder is used, then the coating will become multi-layered. On one embodiment, a range from 0 percent to 50 percent by weight of nano powder is used. As a specific example, if 100 grams of micron powder are used, then the range of nano powder used will run from one gram to 50 grams.

In this range, all nano powder becomes bonded to the larger micron particles. That is, in one form of the invention, large islands of non-coating nano powder are not present.

However, it is recognized that a primary purpose of one form of the invention is to provide enhanced chemical and physical properties of a sintered product produced from the powder mixture of the invention. Experimentation may show that certain of these properties may be enhanced, while some islands of nano powder are present. Thus, in some forms of the invention, strict attainment of the uniformity defined herein may not be required.

Moreover, in the illustration being described, this invention can also provide enhanced properties in non-sintered products. For example, one such example is where finer resins are mixed with micron powders to form bonded type of product that does not require any sintering.

Additional Considerations

Two types of energy dispersive X-ray analyses were undertaken. One analysis was of the interior of the large particle shown in FIG. 2. The other analysis was of the surface of the large particle shown in FIG. 2. Resulting plots are shown in FIGS. 4 and 5.

The two analyses indicated that a carbon peak was present in the spectrum of surface-coated particles, but absent from the spectrum of the particle interior. This absence leads to the inference that carbon is present in the coating, which is consistent with the creation of a titanium carbide coating through the processes described herein.

In one form of the invention, the nano powder used as a coating is one-tenth, or less, the size of the coated particle. As a specific example, particles in the 30 nm to 50 nm range will successfully coat particles in the 20 micron to 40 micron range.

In another form of the invention, the nano powder used as a coating is between 0.0005 and 0.1 of the size of the coated particle.

The ball milling preferably is done for 5 minutes to four hours, at room temperature, and without solvents. Under these conditions, no significant mechanical alloying or chemical reaction occurs between the two types of powders.

The short milling times and low milling speeds enable gentle deagglomeration and dispersion of nano powders in micron-size powders to take place with out any solid state diffusion or mechanical alloying.

As stated above, the nano particles used as the coating are harder than the particles which are coated. In one embodiment, the nano particles are at least 2 times harder, using the same hardness scale.

If the nano particles and the micron particles are of the same, or similar, hardness, a third type of particle can be used as an intermediate layer. As one example, the third particle can be (1) of the same size as the nano particles, (2) in the same quantity as the nano particles, and/or (3) softer than the nano particle, but harder than first particle which is of micron-size.

The edges of the harder nano particles can embed into the third particle, and the edges of the third particle can embed into the micron particle. Thus, the third particle forms a type of coating around the micron-size particle, and the nano particles adhere to the coating.

The third particle can also be harder than the other two.

The ball milling described above was done dry, without liquids. Alternately, the ball milling can be done wet, using solvents.

Specific examples of micron-sized powders usable in the invention are the following: copper, aluminum, magnesium, iron, various steels, cobalt, nickel, zinc, zirconium, niobium, molybdenum, palladium, silver, tungsten, hafnium, tantalum, rhenium, platinum, neodymium, samarium, gadolinium, and terbium.

Nano-sized and fine powders for coating these micron-sized powders include alloys of the preceding, other metals, other alloys, ceramics, and resins.

Some distinctions between the present invention and prior art processes should be noted.

In the prior art, ball milling of powders was used to fracture the powders into smaller particle sizes. Sufficiently rigorous, or lengthy, ball milling can produce powders in the nano meter size range. However, such a ball milling process will produce a wide distribution of particle sizes, of a single material type. Further, such ball milling begins with particles much larger than the nano-size particles produced.

This is different from one form of the invention, wherein two different materials are milled, and the initial charge of each material consists of particles of a specified size range, such as 20 micron titanium metal and 20-30 nano meter titanium carbide.

Further, under the invention, the smaller particles are harder than the larger particles, allowing the smaller particles to become mechanically keyed, or bonded, into the larger particles. That bonding will not occur in milling particles of a single type, at least for the reason that the particles are of similar hardness.

The particles in question are generally irregular in shape. Particle size for such particles generally refers to the largest cross-sectional dimension of the particle. Other dimensions can be used, but this particular dimension (largest cross-sectional dimension) is convenient to measure using simple microscopy.

The particles can also be regular shaped such as spherical, cylindrical and variations and combinations of the above.

One definition of ball mill is a hopper containing balls which are harder than materials processed in the hopper, and wherein the hopper is rocked or tumbled, to impact the balls against the materials.

One feature of the invention is that the concentration of nano particles in any volume is proportional to the surface area of the micron particles in that volume. This provides another definition of uniformity of distribution.

For example, if a given volume contains a single large micron-size particle and if nano particles coat the large particle in a single layer, then the number of nano particles depends on the surface area of the large particle.

Similarly, if the nano particles coat the micron particle in two or more layers, then the number nano particles depends on the surface area of the micron particle.

If two different micron particles are present and are coated with nano particles, then the number of nano particles again depends on the total surface area of the micron particles.

Therefore, the concentration of the nano particles, in terms of number of particles in a selected volume, will be generally proportional to the surface area of the micron particles within that volume.

This is a different type of distribution of nano particles, compared with that described in the Background of the Invention, and shown in FIG. 1. In that case, the nano particles agglomerated together, and were found in islands containing few, and possibly no, micron particles. The nano particle concentration was not proportional to the surface area of the micron particles.

A nano-sized powder is defined as one having particle size between 1 and 100 nano meters. A micron-sized powder is defined as one having particle size between 1 and 200 microns.

In the illustration being described, two particulate materials with correct size distributions and ductility's/hardness gently ball milled for short periods, for example, 5 minutes to four hours at low speeds so that harder powder particles (which are also smaller in size) embed onto the surface of ductile larger powder particle matrix. The ball milling times are sufficiently small (only 5-240 minutes) so that no mechanical alloying or chemical reactions take place between the constituents. In the case of mixtures with nano powders, such short gentle milling deagglomerates the nano powders and coats onto micron size powder particle surfaces.

The ball milling conditions for a given ball mill size and grinding media, the milling time and speeds are set to create surface coatings on the matrix powders. Such ball milling of powders can be accomplished in dry form or with the suitable solvents. In this process no substantial chemical reactions or mechanical alloying occurred. For example, a mixture of 300 gms of 20 micron titanium powders of irregular shape with 20-30 nm titanium carbide powders were ball milled in an alumina jar using ¼ inch and 3/16 inch alumina balls at 109 rpm speed. The mixture was ball milled in dry condition for 2 hours.

In addition, in the case of mixture with nano powders, the ball milling deagglomerated the nano powders and then coated the nano powder particles evenly onto the matrix powders. The uniformity and thickness of the coating varies depending on amount of coating particles in the blend, the relative sizes of the matrix and coating particles, milling speeds and time. The coating thickness can be varied based on the amount of coated material in the blend. For example, 0 to 50 weight % of ceramic coatings onto metal matrix powders are demonstrated by this method. In the case of high weight % of hard particle concentrations, the metal particles will have thicker, multiple layers of ceramic coatings. Typically, the coating powder particle size needs to be smaller at least by a factor of 10. For example, nano particles (~30-50 nm) coat very efficiently onto micron size (20-40 microns) matrix powders. FIG. 2 shows the Scanning Electron Micrograph (SEM) of a hybrid coated powder particle at high magnification. The fuzzy surface on the top is nano titanium carbide and inner core powder particle is titanium particle. Energy dispersive x-ray (EDX) of the hybrid powder particle revealed the composition of the top layer to be TiC and composition of the core particle to be titanium. FIG. 4 shows EDX peaks identifying larger titanium particle. Notice that a carbon peak is absent in the spectrum. FIG. 5 shows the identification of smaller coated powder particles as TiC.

Relative hardness of the matrix and coated powders has to be sufficiently different for harder particle to embed onto the surface of the softer particle. For example, nickel matrix powders of 20 micron size are coated with $Si_3N_4$ powders of 20 nanometer size, and titanium powders of 20-80 microns are coated with 20-80 nanometer powders of titanium carbide (TiC), titanium nitride (TiN), titanium boride (TiB), titanium carbonitride (TiCN) and alumina ($Al_2O_3$).

When the matrix and reinforcement have similar hardness, a third material can be used as an intermediate surface to enable coating of the reinforcement to the matrix material.

As mentioned earlier, milling can be done either dry or wet with solvents in air or special environment.

Such powder blends containing hybrid powders of matrix particle with evenly coated hard particles on the surface have good flowability and can be compacted and sintered to obtain desirable properties.

This process is applicable to various powder blends such as metal powders (Cu, Al, Mg, Fe, steel, Co, Ni, Zn, Zr, Nb, Mo, Pd, Ag, W, Hf, Ta, Re, Pt, Nd, Sm, Gd, Tb) and alloy powders of these for blending with resins, or ceramics or with other metals and alloys. For example, the blends of fine/nano ceramic particles onto metal powders such as aluminum, titanium, iron, copper, nickel, tungsten, molybdenum, steel, and their powder alloys.

Under one form of the invention, the ball milling process is insufficient, either in terms of time or vigor of agitation, to further pulverize the component particles. That is, neither the micron nor the nano powders are further fractured into smaller particles to any significant extent.

Numerous substitutions and modifications can be undertaken without departing from the true spirit and scope of the invention. What is desired to be secured by Letters Patent is the invention as defined in the following claims.

What is claimed is:

1. A method, comprising the steps of:

a) placing a volume of first particles into a mill, the first particles ranging in size from 1 nanometer to 100 nanometers;

b) placing a volume of second particles into said mill, the second particles ranging in size from 1 micron to 200 microns;

c) operating said mill at a temperature to mix said first particles and said second particles such that the first particles are distributed generally uniformly among said second particles so that said second particles become substantially coated with said first particles while breaking up the agglomeration of said first particles;

d) performing said placing steps a) and b) and said operating step c) to create at least one surface layer coating of said first particles onto said second particles without any substantial mechanical alloying or chemical reaction taking place between the first particles and second particles;

wherein said volume of said first particles used in said placing step a) is proportional to a surface area of said second particles in said volume of said second particles; and e) compacting and sintering said first and second particles to produce a part.

2. The method according to claim 1, wherein the first particles are harder than the second particles.

3. The method according to claim 2, wherein the method produces a mixture in which the first particles are uniformly dispersed among the second particles such that minimal agglomerations result in a part produced using said mixture.

4. The method according to claim 2, wherein the method produces a mixture in which the first particles predominantly form coatings around second particles.

5. The method according to claim 1, wherein the first and second particles are irregular in shape.

6. The method according to claim 1, wherein the first particles are irregular in shape and the second particles are spherical.

7. The method according to claim 1, wherein the first particles are spherical in shape and the second particles are irregular or acicular.

8. The method according to claim 1, wherein the first particles are spherical in shape and the second particles are also spherical.

9. The method according to claim 1, wherein the method produces a mixture in which the second particles are coated by first particles and no more than twenty-five percent (25%) volume of the first particles are outside said at least one layer coating.

10. The method according to claim 1, wherein said mill is a ball mill that is operated for no more than four hours.

11. The method according to claim 1, wherein the first and second particles are of substantially the same hardness and third particles of different hardness, and in sizes between 100 nanometers and 1 micron, are placed into a hopper prior to running said mill.

12. The method according to claim 1, wherein the method produces a mixture wherein the concentration of first particles in any volume is proportional to a surface area of second particles in that volume.

13. The method as recited in claim 1, wherein said first particles are ceramic, carbide or other metal or alloy powders.

14. The method as recited in claim 1, wherein said second particles are metal and alloy powders.

15. The method as recited in claim 14, wherein said second particles are aluminum, titanium, iron, copper, cobalt, zinc, zirconium, niobium, magnesium, palladium, nickel, silver, tungsten, hafnium, tantalum, rhenium, platinum, neodymium, samarium, gadolinium, molybdenum, steel, terbium and their powder alloys.

16. The method as recited in claim 14, wherein said first particles are oxides, nitrides, carbides, carbonitride, carbooxide, silicon, silicon oxide, silicon nitride, silicon carbide, carbon nano tubes, alumina, zirconia, Hafnia, titanium oxide, titanium carbide, titanium nitride, titanium carbonitride, titanium carbooxide and other hard particles.

17. The method as recited in claim 1, wherein said method further comprises the step of:

a) operating said mill in air, vacuum, inert (argon), oxidizing or reducing atmosphere.

18. The method as recited in claim 1, wherein said method further comprises the step of:

selecting said volume of said first particles in proportion to a surface area of said volume of said second particles.

19. The method as recited in claim 18, wherein said selecting step further comprises the step of:

increasing said volume of said first particles if it is desired to provide a multi-layered coating of said first particles onto said second particles.

20. A method comprising:

combining a nano-sized powder of one material ranging in size from 1 nanometer to 100 nanometers with a micron-sized powder of another material ranging in size from 1 micron to 200 microns;

milling the particles to produce a mixture in which the number of nano-sized particles in any volume is substantially proportional to the surface area of micron-sized particles in the volume;

performing said milling step using a temperature that causes the nano-sized powder to be distributed generally uniformly among said micron-sized powder so that the micron-sized powder becomes substantially coated with said nano-sized powder to create at least one surface layer coating of said nano-sized powder onto said micron-sized powder;

wherein said milling step is performed without any substantial mechanical alloying or chemical reaction taking place between the nano-sized powder and said micron-sized powder;

wherein said volume of said first particles used in said placing step a) is proportional to a surface area of said volume of said second particles; and compacting and sintering said mixture to produce a part.

21. The method as cited in claim 20 wherein the method comprises the step of:

milling said mixture between 15-240 minutes so that little or no mechanical alloying take place between said powders.

22. The method as cited in claim 20, wherein the soft powder is at least 10 times greater in size than the hard powder.

23. A coating method comprising the steps of:

preparing a mixture which includes a relatively hard powder of average particle size X, and a relatively soft powder of average particle size greater than X;

subjecting the mixture to milling for no more than four hours;

performing said milling step using a temperature that causes the hard powder to be distributed generally uniformly among said soft powder so that the soft powder becomes substantially coated onto said hard powder to create at least one surface layer coating of said hard powder onto said soft powder;

wherein said milling step is performed without any substantial mechanical alloying or chemical reaction taking place between said hard powder and said soft powder;

wherein said volume of said first particles used in said placing step a) is proportional to a surface area of said volume of said second particles;

wherein the method produces a mixture in which the first particles are uniformly dispersed among the second particles such that minimal agglomerations result in a part produced using said mixture; and compacting and sintering said mixture to produce a part.

* * * * *